US006276753B1

(12) United States Patent
Sur et al.

(10) Patent No.: US 6,276,753 B1
(45) Date of Patent: Aug. 21, 2001

(54) CHAIR OR SOFA WITH REFRIGERATED COMPARTMENT

(75) Inventors: Kenneth C. Sur, 2507 Arnold Dr., Monroe, NC (US) 28110; Ann Ferguson, 137 E. 36th St., New York, NY (US) 10016; Roy J. Topelko, Cambridge (CA)

(73) Assignees: Kenneth C. Sur, Monroe, NC (US); Ann Ferguson, New York, NY (US)

( * ) Notice: Subject to any disclaimer, the term of this patent is extended or adjusted under 35 U.S.C. 154(b) by 0 days.

(21) Appl. No.: 09/552,796

(22) Filed: Apr. 20, 2000

Related U.S. Application Data

(63) Continuation of application No. 09/335,843, filed on Jun. 18, 1999, now Pat. No. 6,106,058.

(51) Int. Cl.[7] ..... A47C 7/62
(52) U.S. Cl. ..... 297/188.19; 297/217.3
(58) Field of Search ..... 297/188.14, 188.19, 297/188.01, 68, 188.13, 188.08, 180.12, 217.3, 217.1, 463.2; 62/3.2, 3.6, 3.61, 3.62, 3.63, 261, 331

(56) References Cited

U.S. PATENT DOCUMENTS

| | | |
|---|---|---|
| 1,702,955 | 2/1929 | Zaday . |
| 2,494,838 | 1/1950 | Slaughter . |
| 2,812,227 | 11/1957 | Hill . |
| 3,168,816 | 2/1965 | Petrie . |
| 4,146,279 | 3/1979 | Stahel . |
| 4,191,420 | 3/1980 | Fassett et al. . |
| 4,474,407 | 10/1984 | Nazar . |
| 4,543,798 | 10/1985 | Page . |
| 4,650,245 | 3/1987 | Nazar . |
| 4,652,048 | 3/1987 | Nazar . |
| 4,719,764 | 1/1988 | Cook . |
| 4,818,017 | 4/1989 | Dykstra et al. . |
| 4,854,536 | 8/1989 | Lorence et al. . |
| 4,928,865 | 5/1990 | Lorence et al. . |
| 5,025,639 | 6/1991 | Thomas . |
| 5,062,557 | 11/1991 | Mahvi et al. . |
| 5,086,769 | 2/1992 | Vianello et al. . |
| 5,116,099 | 5/1992 | Kwasnik et al. . |
| 5,230,450 | 7/1993 | Mahvi et al. . |
| 5,269,157 | 12/1993 | Ciminelli et al. . |
| 5,282,671 | 2/1994 | Funk . |
| 5,350,215 | 9/1994 | DeMars . |
| 5,395,157 | 3/1995 | Rollo et al. . |
| 5,448,788 | 9/1995 | Wu . |
| 5,515,564 | 5/1996 | Lyons . |
| 5,628,544 | 5/1997 | Goodman et al. . |
| 5,641,197 | 6/1997 | Springmann . |
| 5,660,296 | 8/1997 | Greenwich . |
| 5,722,717 | 3/1998 | Rettenberger . |

FOREIGN PATENT DOCUMENTS

| | | |
|---|---|---|
| 3137671 A1 | 4/1983 | (DE) . |

OTHER PUBLICATIONS

"Cool–Tooler"; Advertisement for U.S. Patent No. 4,543,798; Published prior to Apr. 20, 2000; entire publication.

*Primary Examiner*—Milton Nelson, Jr.
(74) *Attorney, Agent, or Firm*—Adams, Schwartz & Evans, P.A.

(57) ABSTRACT

A seating device including a seat, an enclosed armrest adjacent to the seat, and a thermoelectric refrigeration compartment, mounted within the armrest is provided. The armrest includes an upper portion connected to a main portion of the armrest by a hinge along an outer surface thereof, movable away from a home position against the main portion of the armrest, the compartment preferably being mounted in the main portion such that moving the upper portion away from the home position exposes the upper surface of the compartment. The compartment may have an upwardly opening lid which opens to a thermoelectrically cooled or heated cavity which may be sized to accept several beverage containers or in an alternate embodiment it may be sized to accept one upright beverage container.

12 Claims, 7 Drawing Sheets

CHAIR OR SOFA WITH REFRIGERATED COMPARTMENT

REFERENCE TO RELATED APPLICATIONS

This is a continuation of application Ser. No. 09/335,843, filed Jun. 18, 1999 now U.S. Pat. No. 6,106,058.

BACKGROUND OF THE INVENTION

1. Field of the Invention

This invention relates to a chair or sofa including a refrigeration compartment mounted within an armrest.

2. Description of the Prior Art

Chairs and sofas including a refrigerated storage compartment are known. For example, U.S. Pat. No. 4,719,764 to Cook (the "Cook patent") teaches a chair having an armrest with a beverage holding cooler incorporated therein, operatively associated with a refrigeration system and a small refrigeration compartment in the vertical side portion of the chair. The Cook patent utilizes a conventional mechanical compression expansion type refrigeration system including a compressor coil and motor compressor unit, having adequate capacity to cool the contents of the cold storage unit and the beverage can or bottle holding cooler. The system disclosed in the Cook patent is not adaptable to provide heat to the compartment.

The refrigeration compartment disclosed in the Cook patent is accessed by an exposed side door. Its beverage cooling holder consists of an cylindrical opening in the upper surface of an armrest, extending into the armrest, into which a can or bottle may be inserted. Evaporation coils are positioned adjacent to the beverage cooling holder and extend into the interior of the refrigeration compartment in order to maintain a reduced temperature.

The components of the refrigeration system disclosed in the Cook patent require substantial space. Additionally, access to the refrigeration compartment through the exposed side door may not be as convenient as access through an upwardly opening lid. As such, there is a need for a chair or sofa with a compartment which utilizes a more space efficient cooling means, which may easily be converted to a heating compartment and which may be easily accessed.

SUMMARY OF THE INVENTION

It is an object of the invention to provide an improved chair or sofa including a refrigeration compartment therein. In accordance with an aspect of the invention there is provided a chair or sofa comprising a seat, an enclosed armrest adjacent to the seat, and a thermoelectric refrigeration compartment, mounted within the armrest.

In accordance with another aspect of the invention, the compartment may include an upwardly opening lid. The armrest may include an upper portion movable away from a home position against a main portion of the armrest, the compartment being mounted in the main portion, whereby moving the upper portion away from the home position exposes the lid.

The compartment may be sized and shaped to store a number of standard sized beverage containers or in the alternative it may be sized to accept one upright cylindrical beverage container such that the container may be accessed by the occupant of the chair. The compartment may be thermoelectrically cooled or heated.

The invention as described herein provides the advantage of including a thermoelectric refrigeration compartment which requires less space, which may be converted to a heating compartment, and which may be more easily accessed by an occupant of the chair or sofa than the chairs with refrigeration compartments disclosed in the prior art. A further advantage is provided as the compartment may be concealed when not in use, thus improving the aesthetics of the chair.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED AND ALTERNATE EMBODIMENT

Figure 1:
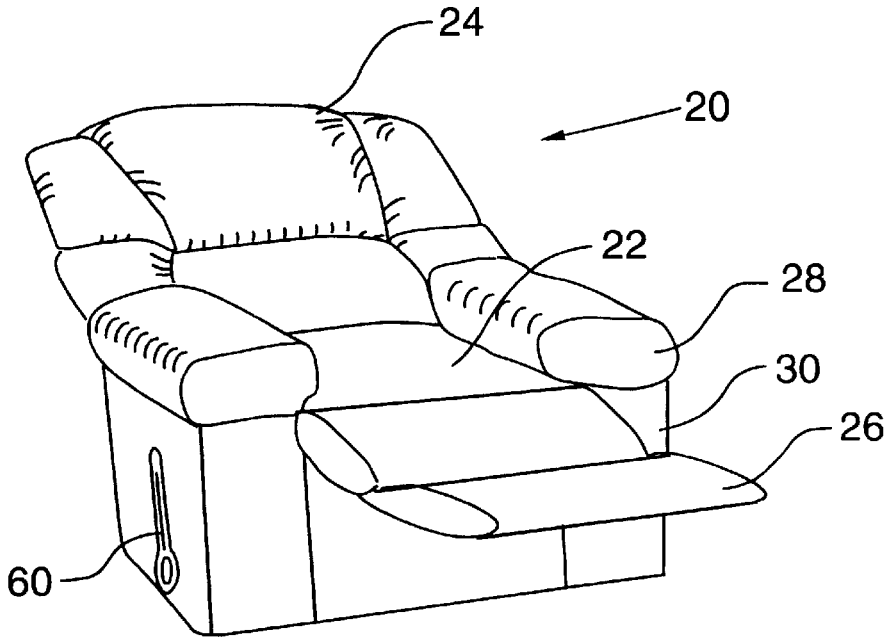
FIG. 1 is a perspective view of the preferred embodiment of the invention in the reclined position with upper portion of the armrest in home position.
Figure 2:
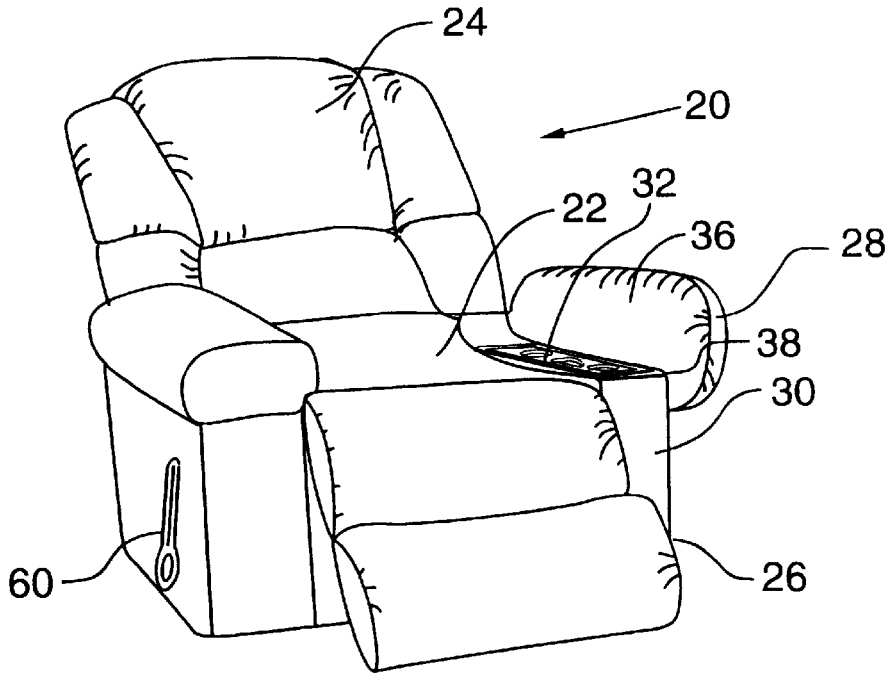
FIG. 2 is a perspective view of the preferred embodiment of the invention in the upright position with the upper portion of the armrest in the open position.
Figure 3:
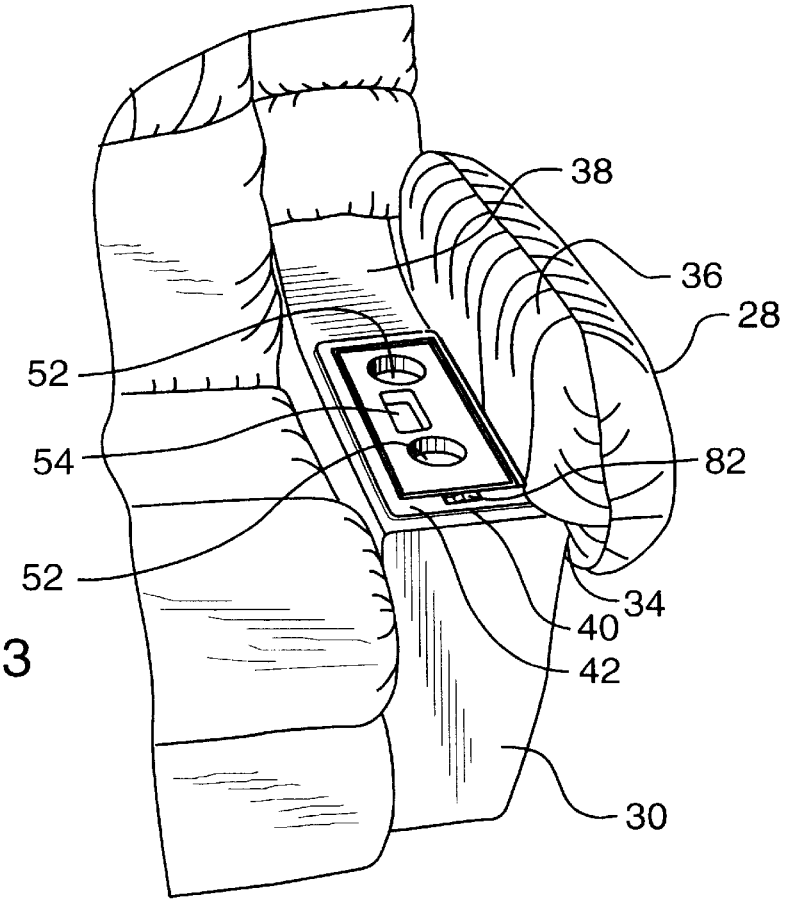
FIG. 3 is a perspective view of compartment and armrest of the preferred embodiment of the invention with compartment lid exposed.
Figure 4:
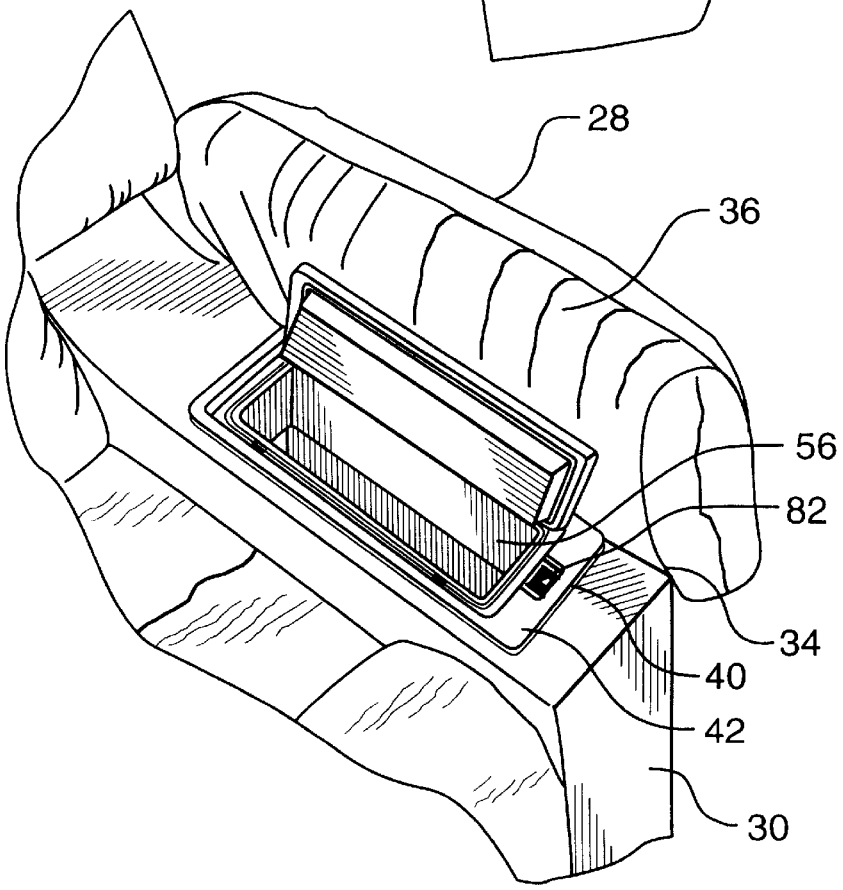
FIG. 4 is perspective view of compartment and armrest of the preferred embodiment with lid open.

The preferred embodiment as shown in FIGS. 1–8, provides a seating device 20 including a seat 22, backrest 24, footrest 26 and an armrest. The armrest includes an upper portion 28 mounted to a main portion 30, which includes an enclosed interior space 31, within which a thermoelectric refrigeration compartment 32 is mounted. The upper portion of the armrest is mounted to the main portion by a hinge along an outer edge 34 thereof. The upper portion 28 is movable away from a home position, as shown in FIG. 1 to an open position as shown in FIGS. 2, 3 and 4. Preferably, the upper portion of the armrest has a generally planar bottom surface 36 and the main portion has a generally planar upper surface 38.

In the preferred embodiment, the refrigeration compartment is mounted within the main portion of the armrest, configured to fit within a cavity in the upper surface of the main portion. The upper surface 40 of the compartment includes a laterally extending peripheral flange 42, such that when the compartment is inserted into the main portion, the flange rests upon the upper surface 38 of the main portion, supporting the compartment.

Figure 5:
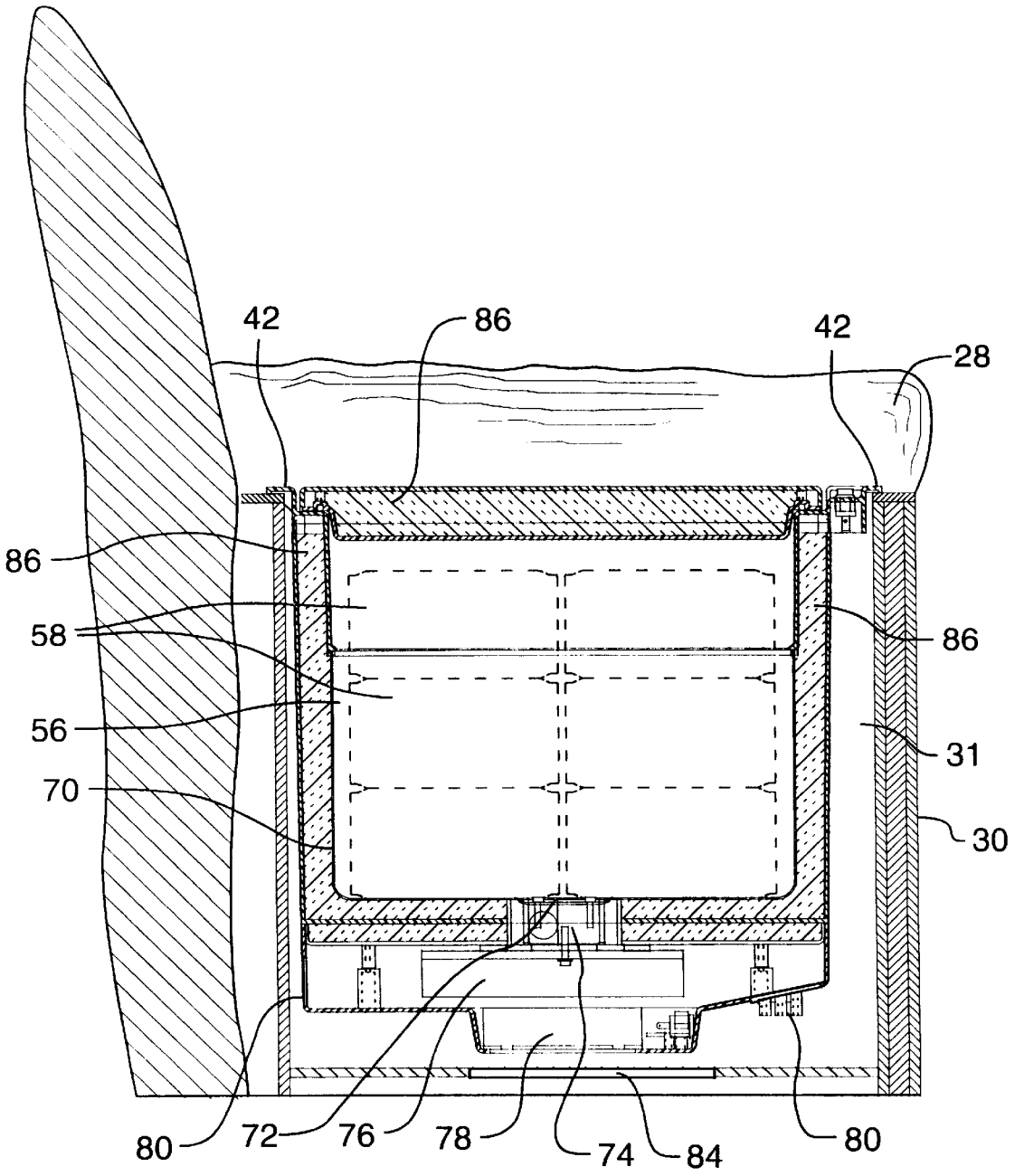
FIG. 5 is side sectional view of compartment mounted within an armrest of preferred embodiment with upper portion in the home position.
Figure 6:
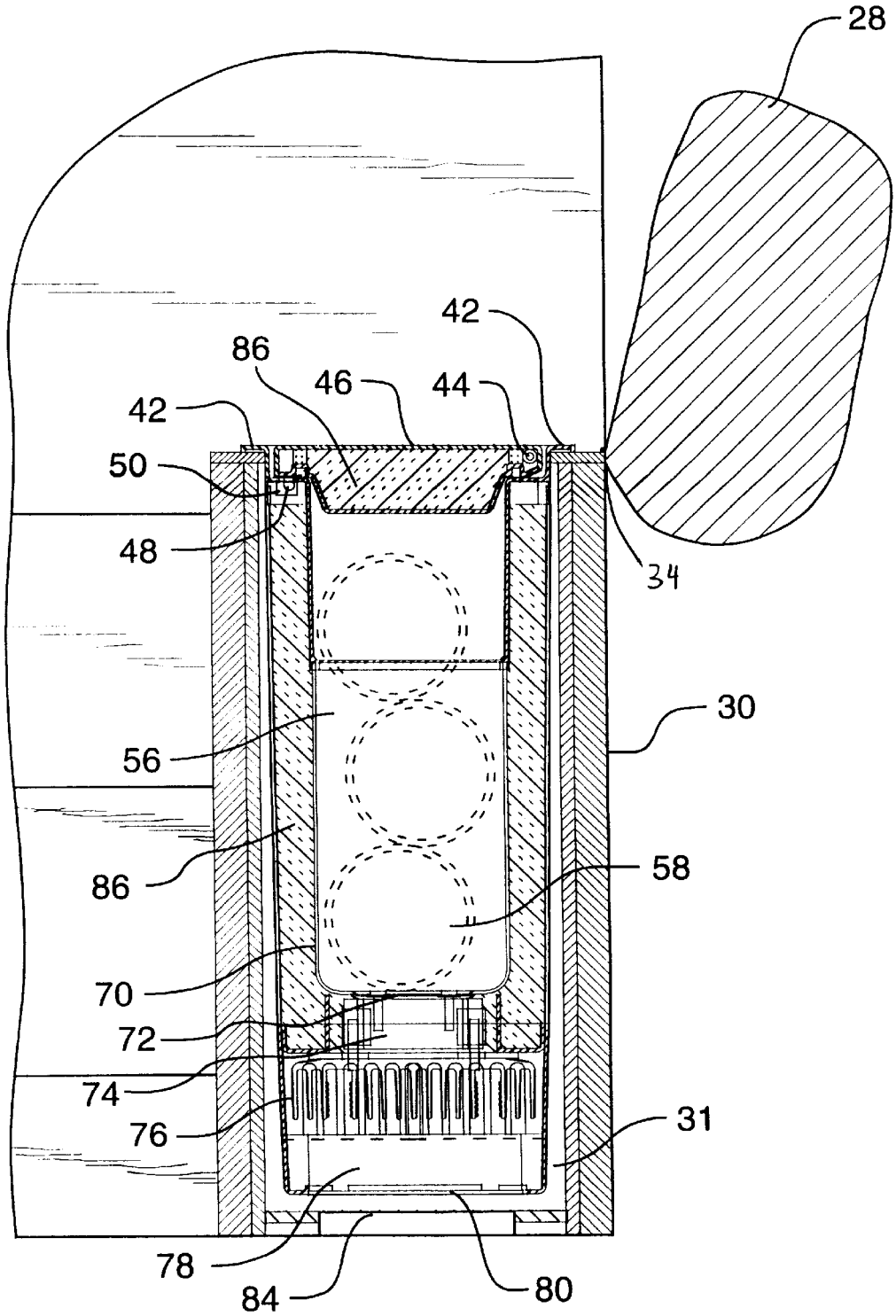
FIG. 6 is end sectional view of compartment of the preferred embodiment mounted within armrest with upper portion in the open position.

Moving the upper portion 28 away from the home position exposes the upper surface 40 of the compartment and the lid 46, enabling the lid to be accessed. As shown in FIG. 3, the upper surface of the lid may also include at least one cylindrically shaped recess 52, and preferably two such recesses. Such a recess may be utilized to hold an upright beverage when the lid is closed. The lid may be opened by means of a handle 54 positioned on its upper surface, opening to an internal refrigeration cavity 56. As shown in FIGS. 5 and 6, preferably this cavity is sized to accept approximately 6 standard sized (355 ml) beverage containers 58.

Figure 7:
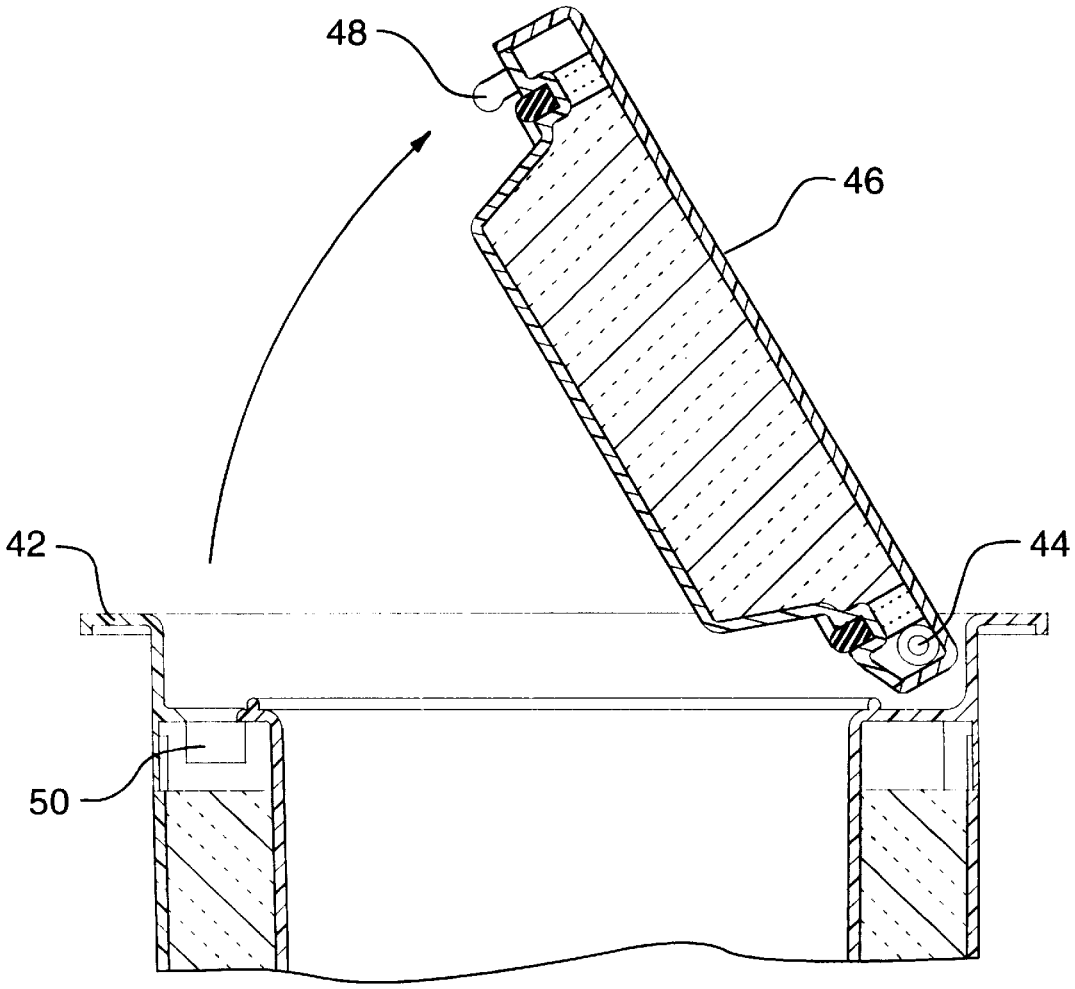
FIG. 7 is sectional side view of an open lid and upper portion of compartment of the preferred embodiment.
Figure 8:
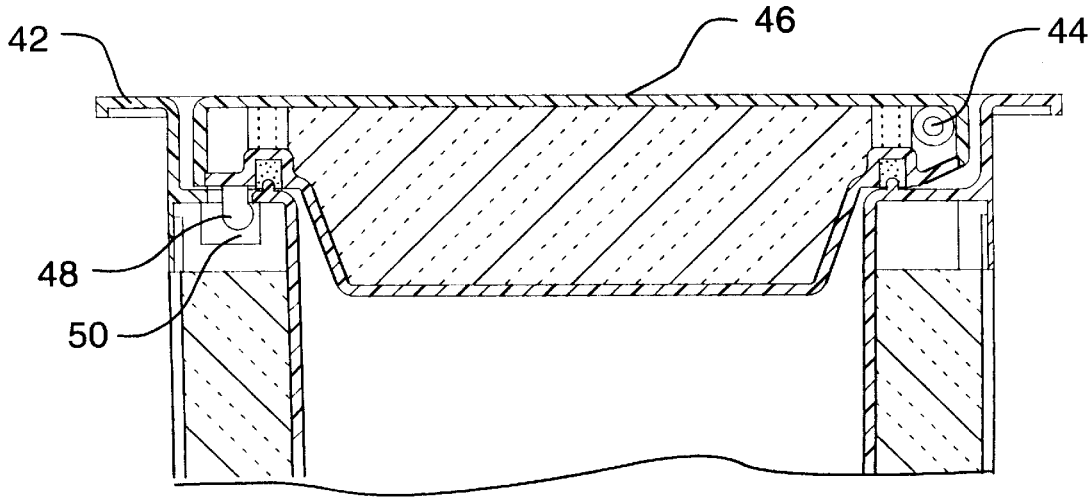
FIG. 8 is a sectional side view of a closed lid and upper portion of compartment of the preferred embodiment.

As shown in detail in FIGS. 7 and 8, attached to the upper surface of the compartment preferably by a hinge 44 is the upwardly opening lid 46. The lid is releasably secured to the compartment in a closed position by means of at least one resilient catch tongue piece 48 which may be releasably inserted into a complementary groove 50 in the upper surface of the compartment which releasably catches the tongue.

Preferably, the seating device is adjustable from an upright position, shown in FIG. 2, to a reclined position, shown in FIG. 1, by utilizing a reclining mechanism 60, which causes the backrest to pivot to a reclined position and the footrest that is normally in a generally vertical orientation to move to a horizontal position in order to support the feet of the occupant of the chair. Preferably, the compartment is mounted in the armrest which does not include the reclining mechanism.

The refrigeration cavity within the compartment is cooled by a thermoelectric cooling system, which requires less space than the comparable vapour compression or absorption refrigeration system. As best shown in FIGS. 5 and 6 the thermoelectric cooling system includes a cold plate 70, thermoelectric module 72, extender block 741 heat sink 76, a fan 78 and vents 80 for dissipating heat. The cooling system is operated by an activation switch 82 located on the upper surface of the compartment which directs DC current to be sent through the thermoelectric module.

According to the Peltier effect, as DC electric current is sent through the conventional thermoelectric module 72 comprising both p type (deficiency of electrons) semiconductor element and n type (excess of electrons) semiconductor element, which sit adjacent to the cavity 56, heat is transferred out of the cavity 56 to the adjacent heat sink 76 as follows.

At the junction between the cold plate and the thermoelectric module 72 heat is absorbed by electrons as they pass from the p type semiconductor element to the n type semiconductor element. At the junction between the thermoelectric module and the heat sink, energy is expelled to the heat sink as the electrons move from n type element to the p type element. Vents 80 in the compartment communicate with an opening 84 in the bottom of the main portion. The fan 78, positioned below the heat sink 76, blows heat away from the heat sink through the vents and out through the opening 84 in the bottom of the main portion of the armrest.

Heat may be transferred into the compartment by reversing the current across the thermoelectric module. As such, the compartment may act as a heating compartment if the current is so reversed. Thus the activation switch 82 positioned on the upper surface of the compartment may be switched to cause the current to travel in the reverse direction across the thermoelectric module.

The compartment and compartment lid are insulated with suitable insulation material 86 so as to limit undesired heat transfer.

Alternate Embodiment

Figure 9:
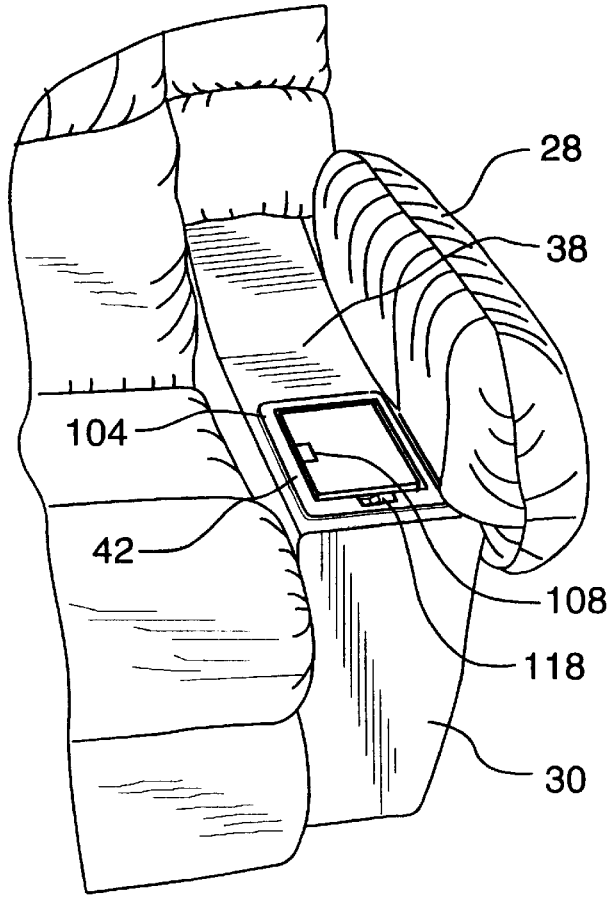
FIG. 9 is a perspective view of the armrest and compartment of an alternate embodiment of the invention with compartment lid closed.
Figure 10:
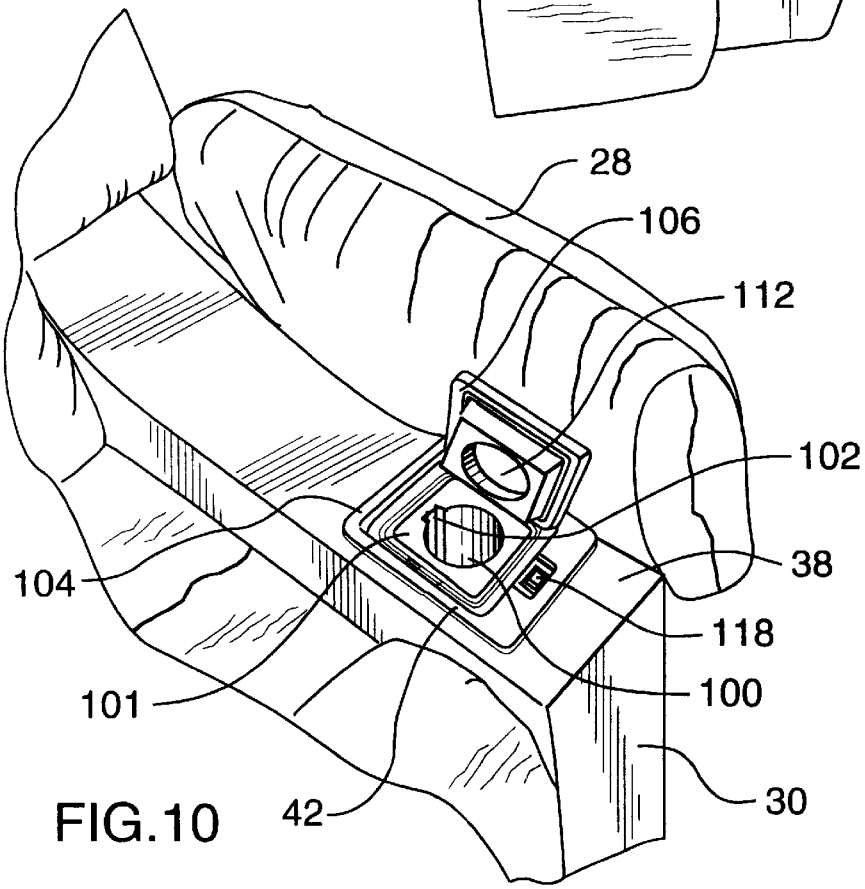
FIG. 10 is a perspective view of the armrest and compartment of an alternate embodiment of the invention with compartment lid open.
Figure 11:
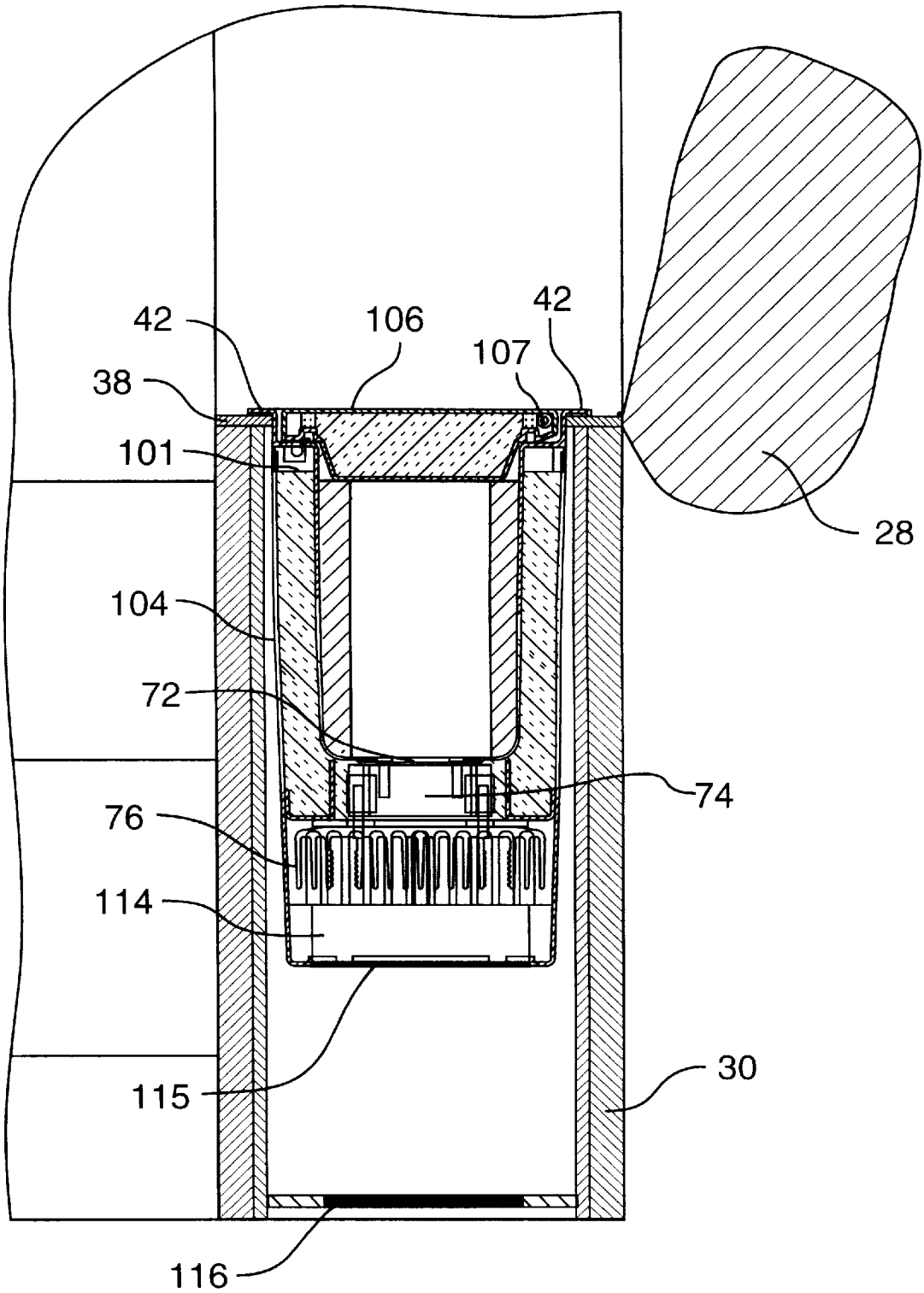
FIG. 11 is an end sectional view of an alternate embodiment of the compartment mounted in the armrest.

As shown in FIGS. 9–11 an alternate embodiment of the refrigeration compartment includes a cylindrical thermoelectric refrigeration cavity 100, extending from a sunken portion of the upper surface 101 of the compartment into the compartment. The cavity is preferably sized and configured (approximately 3½ to 4½ inches in cross sectional diameter and approximately 4 to 6 inches in depth), to accept a standard sized beverage can, bottle, glass or cup such that a small portion of such a beverage container once inserted within the cavity will extend above the upper surface of the cavity so that it may be accessed by the user. Preferably, the cavity also includes a space 102 to accept a beverage container handle such as the handle of a beverage mug.

As in the preferred embodiment, the compartment 104 is mounted within the main portion of the armrest, configured to fit within a cavity in the main portion. The upper surface of the compartment includes a laterally extending peripheral flange 42, which sits upon the upper surface 38 of the main portion, supporting the compartment when inserted into the cavity in the main portion. The upwardly opening lid 106 of the alternate embodiment is attached to the upper surface of the compartment preferably by a hinge 107. The lid may be opened by means of a handle 108 positioned on its upper surface. When the lid is closed, the upper surface of the lid is preferably flush with the upper surface 38 of the main portion 30 of the armrest, allowing the upper portion 28 of the armrest to cover the lid when the upper portion is in the home position. When the lid is closed the bottom surface of the lid is flush with the sunken portion 101 of upper surface of the compartment.

The lid may include a cylindrical recess 112 extending upwardly from its lower surface, aligned with the cylindrical cavity. The recess is positioned and sized to allow a beverage sitting in the refrigeration cavity 100 with a portion extending out of the cavity's upper opening to extend within the recess and thus allow the lid to be closed with a beverage container sitting in the refrigeration cavity.

As in the preferred embodiment, moving the upper portion 28 of the armrest away from the home position exposes the lid, enabling the refrigeration cavity 100 to be accessed by opening the lid.

As in the preferred embodiment, the heat sink 76 is positioned below the thermoelectric module 72 and absorbs the heat which is transferred out from the cavity 100. Heat accumulating at the heat sink is blown out by a fan 114 through the vents 115 which communicate with an opening in the bottom of the main portion 116. Because heat may be transferred into the cavity 100 by reversing the current across the thermoelectric module, the cavity 100 of the alternate embodiment may act as a heating compartment if the current is so reversed. Thus the activation switch 118 positioned on the upper surface of the compartment may be switched to cause the current to travel in the reverse direction across the thermoelectric module.

It will be appreciated that the above description relates to the preferred and alternate embodiments by way of example only. Many variations on the invention will be obvious to those knowledgeable in the field, and such obvious variations are within the scope of the invention as described and claimed, whether or not expressly described. For example the chair may be of rigid structure or may be a reclining chair as in the preferred embodiment. Additionally the compartment may be any suitable shape or size and the compartment may or may not include an upper opening lid, the lid may or may not be removable, and the electric current may be provided to the thermoelectric system by any suitable source.

What is claimed as the invention is:

1. A seating device, comprising:

(a) a seat for supporting a seated user thereon; and (b) an armrest positioned adjacent and connected to said seat, comprising:

(i) a thermoelectric refrigerator mounted within said armrest and having an upwardly-directed opening and a lid mounted adjacent thereto and movable between a closed position for sealing said refrigerator and an open position for permitting access to the refrigerator; and (ii) an armrest cover movably connected to the armrest and movable between a closed position for supporting an arm of the seated user and an open position for permitting the seated user to gain access to the refrigerator.

2. A seating device as recited in claim 1, wherein said refrigerator is adapted for being cooled or heated.

3. A seating device as recited in claim 1, wherein said lid includes at least one resilient catch tongue piece for being releasably inserted into a complementary groove formed in an exterior surface of the refrigerator.

4. A seating device as recited in claim 1, wherein said lid is pivotally connected to the refrigerator by a hinge.

5. A seating device as recited in claim 1, wherein said lid includes an upper surface defining at least one circular recess adapted for receiving a beverage container therein.

6. A seating device as recited in claim 1, Wherein said armrest cover is pivotally connected to the armrest by a hinge.

7. A seating device as recited in claim 1, and including a seat back portion engaging the seat and movable between an upright position and a reclining position.

8. A seating device as recited in claim 1, wherein said armrest cover includes a planar bottom surface adapted for sealing engagement with a complementary planar upper face of the armrest, and the refrigerator is mounted within the armrest at a depth sufficient for preventing the lid from extending through the opening and beyond said planar upper surface when the lid is in said closed position.

9. A seating device as recited in claim 8, wherein said refrigerator further comprises a laterally-extending peripheral flange positioned adjacent the opening of the refrigerator and engaging the planar upper surface of the armrest for maintaining the refrigerator in a stationary position within the armrest.

10. A seating device as recited in claim 8, wherein said refrigerator further comprises cylindrically-shaped interior sidewalls integrally formed with and extending downwardly from the opening of the refrigerator.

11. A seating device as recited in claim 10, wherein said interior sidewalls define an interior having a cross-sectional diameter between 3½ and 4½ inches and a depth between 4 and 6 inches.

12. A seating device as recited in claim 10, wherein said interior sidewalls define a space adapted for receiving a beverage container handle therein.

* * * * *